US009839829B2

(12) United States Patent
Loucareas

(10) Patent No.: US 9,839,829 B2
(45) Date of Patent: Dec. 12, 2017

(54) TENNIS SWING TRAINING SYSTEM

(71) Applicant: Angelo Loucareas, Springtown, PA (US)

(72) Inventor: Angelo Loucareas, Springtown, PA (US)

( * ) Notice: Subject to any disclaimer, the term of this patent is extended or adjusted under 35 U.S.C. 154(b) by 78 days.

(21) Appl. No.: 14/950,099

(22) Filed: Nov. 24, 2015

(65) Prior Publication Data

US 2017/0144048 A1 May 25, 2017

(51) Int. Cl.
*A63B 69/38* (2006.01)

(52) U.S. Cl.
CPC ..... *A63B 69/38* (2013.01)

(58) Field of Classification Search
CPC ..... A63B 69/36; A63B 69/38; A63B 69/385; A63B 69/3641
See application file for complete search history.

(56) References Cited

U.S. PATENT DOCUMENTS 1,567,530 A * 12/1925 MacNaughton ... A63B 69/3641 473/229
4,105,204 A * 8/1978 Koenig ..... A63B 69/38 473/461
5,072,942 A * 12/1991 Hurley ..... A63B 69/3644 473/229
5,322,276 A * 6/1994 Hardison, Jr. ..... A63B 69/3644 473/417
5,441,255 A * 8/1995 Verbick ..... A63B 23/03508 473/422
5,595,545 A * 1/1997 O'Brien ..... A63B 69/3644 473/259
5,895,327 A * 4/1999 Francisco ..... A63B 69/3644 473/229
6,056,653 A * 5/2000 Boldin ..... A63B 69/38 473/461
7,074,133 B1 * 7/2006 Jones ..... A63B 69/3641 473/226
9,227,130 B1 * 1/2016 Burdick ..... A63B 69/385
2003/0153411 A1 * 8/2003 Obidiegwu ..... A63B 69/38 473/461
2006/0128492 A1 * 6/2006 Hourihan ..... A63B 69/3685 473/257
2016/0243396 A1 * 8/2016 Taylor ..... A63B 21/4049

* cited by examiner

*Primary Examiner* — Raleigh W Chiu
(74) *Attorney, Agent, or Firm* — Antonio Papageorgiou Meister Seelig & Fein LLP

(57) ABSTRACT

A tennis training system is provided that includes a track assembly and a handle assembly. The track assembly includes a track coupled to a base, the track having a plurality of interlocking tubular sections that mimics a preferred tennis swing. Then handle assembly includes a racket handle and a clip pivotally attached to the handle. The clip is removably attachable to the track in a sliding engagement along the length of the track to develop muscle memory as the user guides the handle assemble along the length of the track.

17 Claims, 5 Drawing Sheets

TENNIS SWING TRAINING SYSTEM

BACKGROUND OF THE INVENTION

The present application relates to tennis training devices, in particular to devices which train a person in the proper form of the forehand and backhand swing.

Traditionally, developing the proper form to make contact with the ball in a consistent, successful manner has required a tennis student to take many hours of expensive lessons; in the past, it has been a requirement that a coach or teacher be available to assist the student in developing proper form by physically guiding them in the proper swing, and serving as a model for the student. Even with such coaching, it is often difficult for the student to "feel" what a successful swing feels like in practice. Successful tennis players at the highest levels of performance solve this problem by spending thousands of hours practicing and developing an innate, unconscious response to the serve ("muscle memory"). Such practice sessions, both due to time and money considerations, are out of reach of all but the most dedicated players.

Accordingly, there is a need for a tennis training device that assists users in developing their tennis swing that is not so limited.

SUMMARY OF THE INVENTION

The tennis training systems described herein solve the problem of having a student mirror or mimic a teacher in the development of a forehand and backhand swing. It allows the student to develop their muscle memory (or reflexive response) by following a set path that never varies from use to use, and which is guided by a three dimensional track designed by a tennis professional.

The system may be comprised one or more of the following three main component parts: a weighted stand or base that holds the training track apparatus, the training track apparatus itself, which is comprised of interlocking pipes or tubes, and a tennis racket handle with a spring-loaded clip on the end that is attached to the training track.

The training track may be made out of custom molded PVC piping. Each track, e.g., forehand and/or backhand track, may be comprised of several, e.g., four, pieces of molded piping, the ends of which interlock to form the track. The first piece of the track, which may be vertical, fits into an opening on the top of the base. The pieces of the track may be keyed for easy alignment. The base, currently comprised of a platform divided by three vertical dividers, each resulting compartment holding a weight, keeps the apparatus stable and immobile during use.

The handle for the device may be comprised of a normal tennis racket base with the racket head/netting removed. Connected to the top of the handle is a spring-loaded metal post with a hinge that pivots. Attached to the pivoting post is a molded C shaped plastic or resin head. Five rotating plastic beads may sit on each side or "horn" of the head, and are secured by the shaped ends of the head.

After the training track is assembled and mounted on the base, the tennis student snaps the plastic head of the handle onto the track piping at a point close to where it mounts to the base. The student may then move the racket handle along the track piping, aided by the rotating plastic beads, which allow a smooth movement, and the pivoting neck of the handle, which allows the student's movement to be natural and unconstrained spatially by the rigidity of the handle. The student can quickly move the racket handle, guided by the head now attached to the training assembly, across the assembly piping and eventually off the end of the training track. This motion mimics in every way a successful forehand or backhand swing (depending on which track is being used). By repeating this process regularly, the student trains his or her muscle memory to the proper form of the desired swing such that, in future play, the movement is instinctive and fluid, and can be executed without the need for conscious adjustment.

The device could be expanded by the development of other training tracks for swings beyond a forehand and backhand stroke.

In at least one aspect, a tennis training system is provided that includes a track assembly that comprises a track coupled to a base, and a handle assembly that comprises a clip that removably attaches the handle assembly to the track in a sliding engagement.

In at least one embodiment, the track comprises a plurality of interlocking tubular sections.

In at least one embodiment, the plurality of interlocking tubular sections comprise at least one straight section and at least one curved section.

In at least one embodiment, the at least one curved section comprises one or more compound curves.

In at least one embodiment, the tennis training system includes a first straight section telescopically coupled to the base, a second curved section coupled to the first straight section, a third straight section coupled to the second curved section, and a fourth curved section, the second curved section comprising a plurality of curves that change direction of the clip attached from a rearward direction toward a forward direction.

In at least one embodiment, the second curved section changes from the rearward direction to the forward direction at a horizontal distance of about 36"-44".

In at least one embodiment, the second curved section causes the clip to drop from the rearward direction to the forward direction at a vertical distance of about 24"-34".

In at least one embodiment, the handle assembly comprises a racket handle and wherein the clip is pivotally coupled to the racket handle.

In at least one embodiment, the clip comprises a plurality of roller bearings disposed between the track and the clip when the clip is attached to the track.

In at least one embodiment, the track comprises a plurality of interlocking tubular sections and wherein the clip has a semicircular shaped head with a diameter greater than a diameter of the tubular sections and an opening in the semicircular shape smaller than the diameter of the tubular sections.

In at least one embodiment, the semicircular head comprises a plurality of horn shaped end.

In at least one embodiment, the handle assembly comprises a pivot post and wherein the clip is pivotally attached to the pivot post via a pivot pin, the clip pivotal about the axis of the pivot pin.

In at least one embodiment, the handle assembly comprises a spring retaining washer and a spring, and wherein the pivot post comprises a spring seat and the clip comprises a spring interface, and wherein the spring is maintained in compression on the pivot post between the spring seat and the spring washer, and wherein the clip spring interface abuts against the spring washer, the spring interface shaped to cause the sprint to compress the spring further as the clip pivots about the pivot pin, thereby resisting pivoting from an upright position.

In another aspect, a tennis training system is provided that includes a track assembly that comprises a track coupled to a base, the track comprising a plurality of interlocking tubular sections; and a handle assembly that comprises a racket handle, a clip having a spring interface, a pivot post having a spring seat, a pivot pin, a spring retaining washer, and a spring, wherein the clip is pivotally coupled to the racket handle via the pivot post, the clip is removably attachable to the track in a sliding engagement, and wherein the spring is maintained in compression on the pivot post between the spring seat and the spring washer, and wherein the spring interface abuts against the spring washer, the spring interface shaped to cause the sprint to compress the spring further as the clip pivots about the pivot pin, thereby resisting pivoting from an upright position.

Additional aspects of the present invention will be apparent in view of the description which follows.

DETAILED DESCRIPTION OF THE INVENTION

Figure 1:
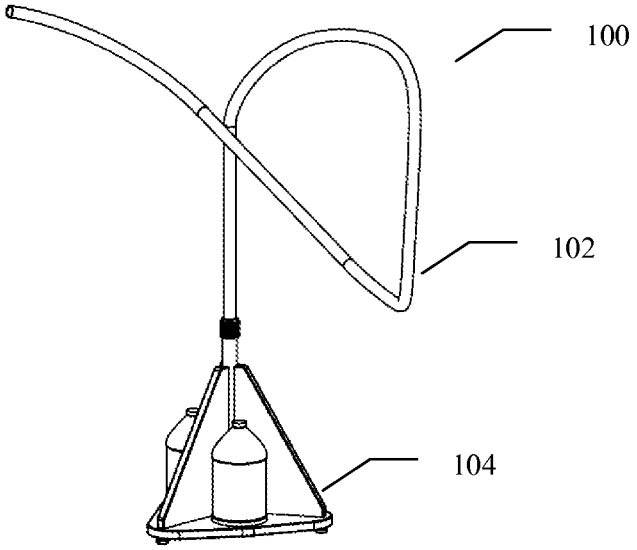
FIG. 1 is a perspective view of a training track in accordance with one embodiment of the training systems disclosed herein.
Figure 2:
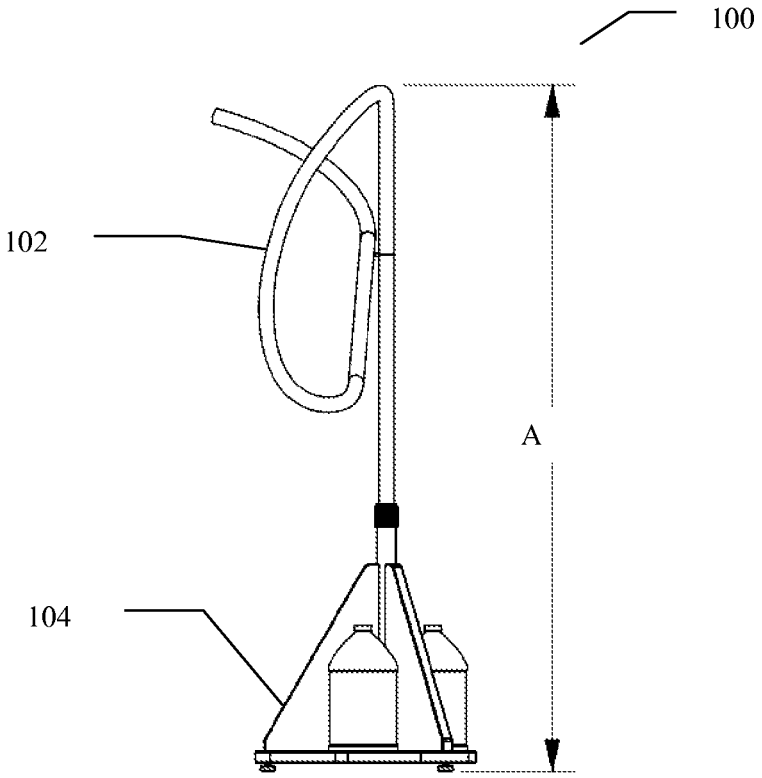
FIG. 2 is a side view of a training track in accordance with one embodiment of the training systems disclosed herein.
Figure 3:
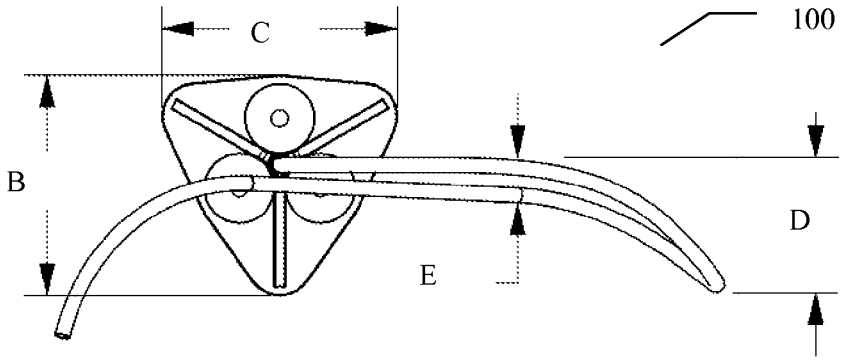
FIG. 3 is a top view of a training track in accordance with one embodiment of the training systems disclosed herein.
Figure 4:
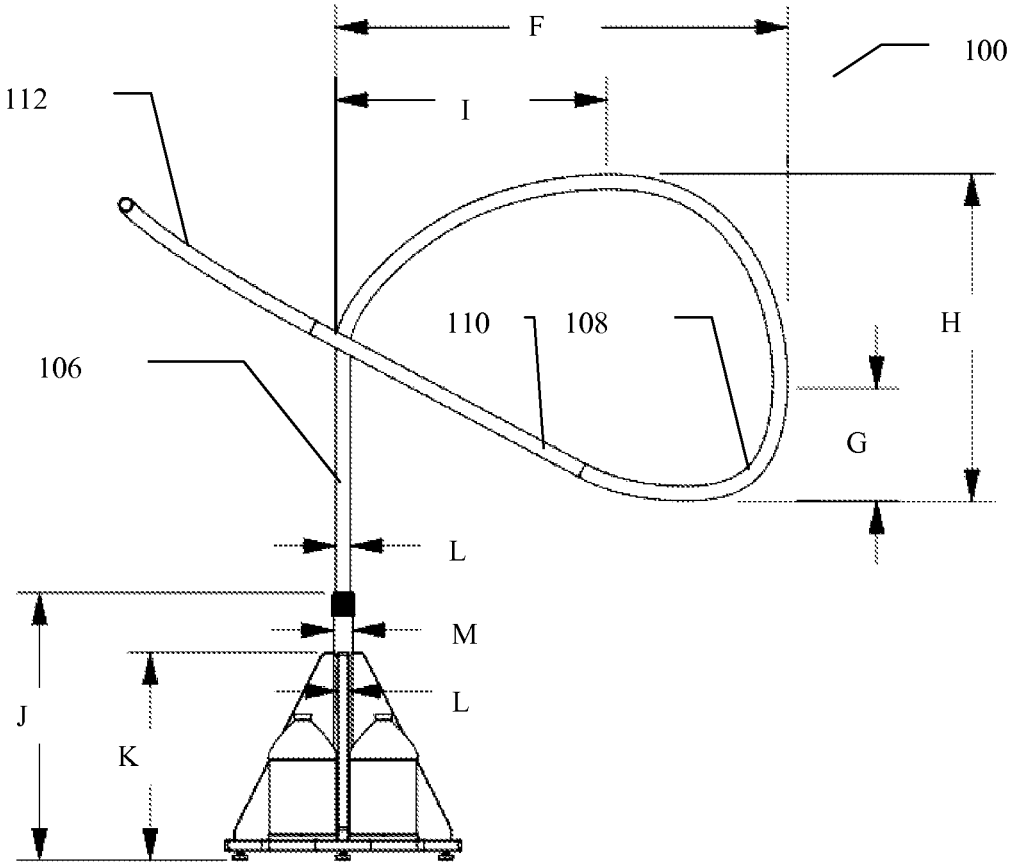
FIG. 4 is a front view of a training handle in accordance with one embodiment of the training systems disclosed herein.

Referring to FIGS. 1-7, the tennis training system, according to at least one embodiment of the systems disclosed herein, includes training track assembly 100 and a removably attachable handle assembly 200. The training track assembly 100 includes a weighted stand or base 104 that holds the tubular track 102. The tubular track 102 is preferably made from a plurality of interlocking tubes preformed in a desired shape. The handle assembly 200 includes a racket handle 202 with a clip 204 on the end that is attached to the training track.

Referring to FIGS. 1-4, the track assembly includes a base 104. The base is preferably weighted to resist tipping of the assembly in use. The weighting may be provided with a plurality of containers that may be filled with a weighty material, i.e., a material having a specific gravity of one or greater, such as water, sand, etc. Extending from the base is a first tubular section 106 that is telescopically coupled to the base. The first tubular section is preferably a straight section. The first tubular section 106 may then be removably coupled to a second tubular section 108. The second tubular section 108 is preferably composed of one or more compound curves. The second tubular section 108 may then be connected to a third tubular section 110 followed by a connection to a fourth tubular section 112. The third section 110 may be a straight section and may be telescopic as well for adjustability. Finally, the fourth section includes at least one curve and/or compound curve. The preferred dimensions of the track assembly 100 are provided in table A below.

| | |
|---|---|
| A - Total Height | 42"-60" |
| B - Base Width | 16"-22" |
| C- Base Width | 16"-22" |
| D - Rearward Lateral Deviation | 8"-16" |
| E - Forward Lateral Deviation | 2"-6" |
| F - Rearward Horizontal Deviation | 36"-44" |
| G - Rearward Vertical Deflection Point | 6"-14" |
| H - Rearward Vertical Deviation | 24"-34" |
| I - Rearward Horizontal Deflection Point | 20"-28" |
| J - Base Height | 20"-28" |
| K - Base Truss Height | 14"-22" |
| L - Base Truss Thickness | 1"-2" |
| M - Tubular Diameter | 1.5"-2.5" |

Figure 5:
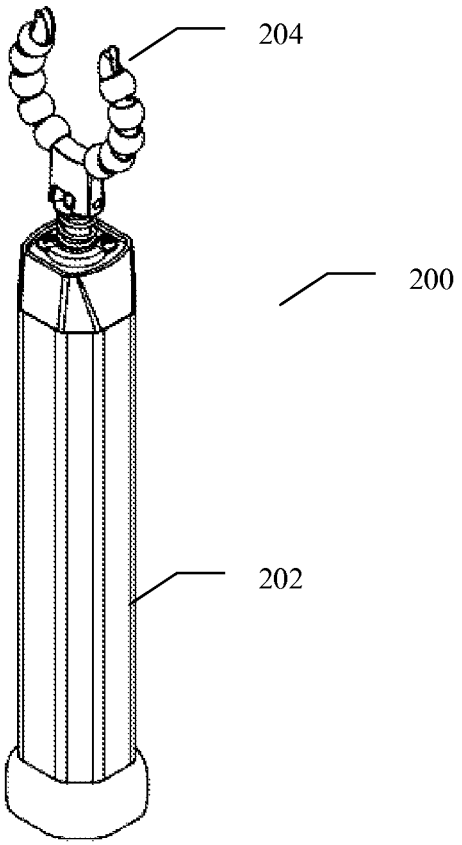
FIG. 5 is a perspective view of a training handle in accordance with one embodiment of the training systems disclosed herein.
Figure 6:
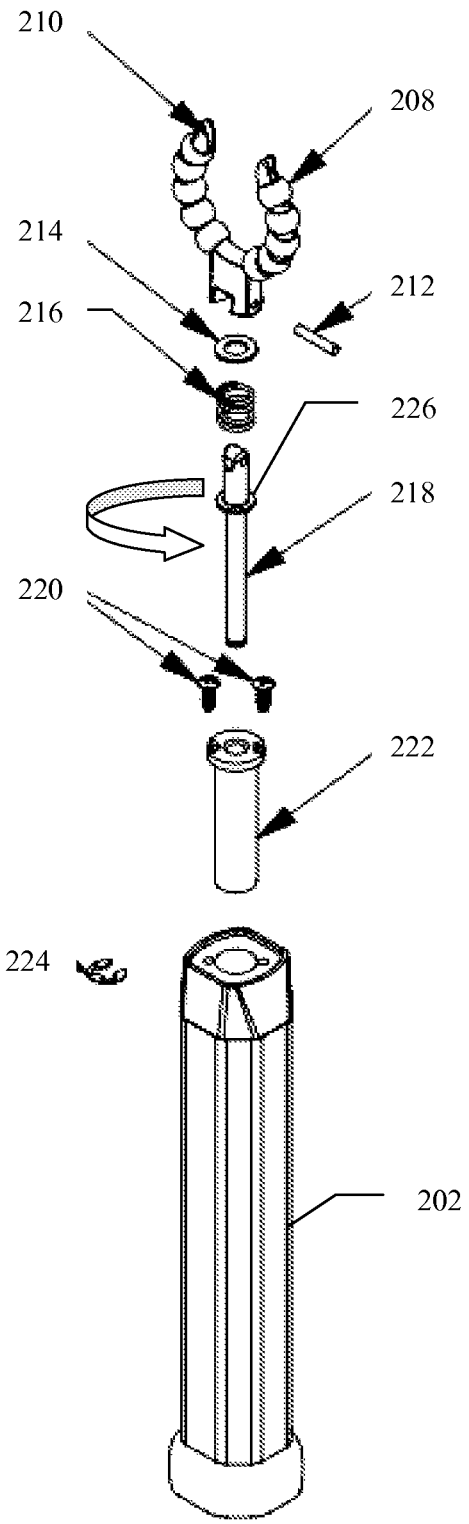
FIG. 6 is an exploded view of a training handle in accordance with one embodiment of the training systems disclosed herein.
Figure 7:
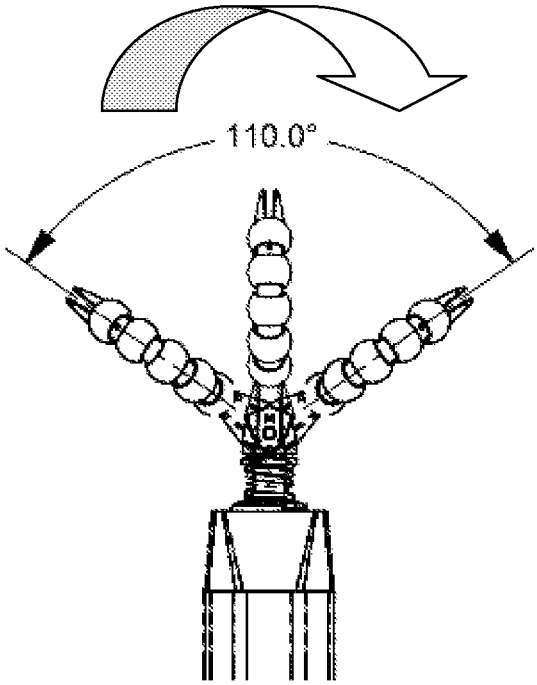
FIG. 7 is a side view of a training handle in accordance with one embodiment of the training systems disclosed herein.

Referring to FIGS. 5-7, the handle assembly 200 includes a racket handle 202 with a clip 204 on the distal end of the handle, which clip 204 is removably attachable to the training track, i.e., the tubular sections 106-112. The clip 204 is further slidable along all or at least some of the training track tubular sections 106-112. Slidability may be enhanced with a plurality of tubular bearings 208. The clip 204 may have a semi circular shaped head with a diameter greater than that of the tubular sections 106-112. The clip head further has an opening therein smaller than the diameter of the tubular sections 106-112 to resist from being detached from tubular sections 106-112. In this regard, each of the "horns" 210 of the head may be sufficiently elastic for the horns 210 to be pulled apart for attachment and detachment to/from the tubular sections 106-112 with some resistance (e.g., 2-10 lbs. of tension).

The clip 204 may be spring loaded and therefore biased to return to the straight or upright position, as shown in FIG. 7. In this regard, the clip 204 would be pivotally coupled to the handle 202 either directly or indirectly (as shown). The pivotal relationship may be achieved with a pivot pin 212 that attaches the clip head to pivot post 218. In this instance, the clip 204 pivots about the axis of pivot pin 212. Spring loading may be achieved with a pivot post 218 that has a spring seat 226 and a spring retaining washer 214, with a spring 216 there between maintained in compression. That is, the clip head, when assembled with pin 212, presses against washer 214 with sufficient force to maintain spring 216 in compression. The interface between the clip head and the washer 214 is shaped such that pivoting of the clip 214 causes the spring 216 to compress further, thereby resisting pivoting and biasing the clip 204 to return to the upright position. The post 218 may be attached to the handle with a housing 222, which is further attached to the handle 202 with screws or other attachment means (such as rivets, nails, adhesive, etc.). In this instance, the post 218 may be attached to the housing 222 to allow the post 218 to rotate axially about the axis of post 218 and/or the hosing 222. Finally, the post 218 may be secured against lateral movement with circlip 224.

While the foregoing invention has been described in some detail for purposes of clarity and understanding, it will be appreciated by one skilled in the art, from a reading of the disclosure, that various changes in form and detail can be made without departing from the true scope of the invention.

What is claimed is:

1. A tennis training system comprising a track assembly that comprises a track coupled to a base, and a handle assembly that comprises a clip that removably attaches the handle assembly to the track in a sliding engagement, wherein the handle assembly comprises a racket handle and wherein the clip is pivotally coupled to the racket handle, the clip comprising a plurality of roller bearings disposed between the track and the clip when the clip is attached to the track, wherein the track comprises a plurality of interlocking tubular sections and wherein the clip has a semicircular shaped head with a diameter greater than a diameter of the tubular sections and an opening in the semicircular shape smaller than the diameter of the tubular sections.

2. The tennis training system of claim 1, wherein the track comprises a plurality of interlocking tubular sections.

3. The tennis training system of claim 2, wherein the plurality of interlocking tubular sections comprise at least one straight section and at least one curved section.

4. The tennis training system of claim 3, wherein the at least one curved section comprises one or more compound curves.

5. The tennis training system of claim 2, comprising a first straight section telescopically coupled to the base, a second curved section coupled to the first straight section, a third straight section coupled to the second curved section, and a fourth curved section, the second curved section comprising a plurality of curves that change direction of the clip attached from a rearward direction toward a forward direction.

6. The tennis training system of claim 5, wherein the second curved section changes from the rearward direction to the forward direction at a horizontal distance of about 36"-44".

7. The tennis training system of claim 5, wherein the second curved section causes the clip to drop from the rearward direction to the forward direction at a vertical distance of about 24"-34".

8. The tennis training system of claim 1, wherein the semicircular head comprises a plurality of horn shaped end.

9. The tennis training system of claim 1, wherein the handle assembly comprises a pivot post and wherein the clip is pivotally attached to the pivot post via a pivot pin, the clip pivotal about the axis of the pivot pin.

10. The tennis training system of claim 9, wherein the handle assembly comprises a spring retaining washer and a spring, and wherein the pivot post comprises a spring seat and the clip comprises a spring interface, and wherein the spring is maintained in compression on the pivot post between the spring seat and the spring washer, and wherein the clip spring interface abuts against the spring washer, the spring interface shaped to cause the sprint to compress the spring further as the clip pivots about the pivot pin, thereby resisting pivoting from an upright position.

11. A tennis training system comprising:

a track assembly that comprises a track coupled to a base, the track comprising a plurality of interlocking tubular sections; and a handle assembly that comprises a racket handle, a clip having a spring interface, a pivot post having a spring seat, a pivot pin, a spring retaining washer, and a spring, wherein the clip is pivotally coupled to the racket handle via the pivot post, the clip is removably attachable to the track in a sliding engagement, and wherein the spring is maintained in compression on the pivot post between the spring seat and the spring washer, and wherein the spring interface abuts against the spring washer, the spring interface shaped to cause the sprint to compress the spring further as the clip pivots about the pivot pin, thereby resisting pivoting from an upright position.

12. The tennis training system of claim 11, wherein the clip comprises a plurality of roller bearings disposed between the track and the clip when the clip is attached to the track.

13. The tennis training system of claim 11, wherein the track comprises a plurality of interlocking tubular sections and wherein the clip has a semicircular shaped head with a diameter greater than a diameter of the tubular sections and an opening in the semicircular shape smaller than the diameter of the tubular sections.

14. The tennis training system of claim 13, wherein the semicircular head comprises a plurality of horn shaped end.

15. The tennis training system of claim 11, comprising a first straight section telescopically coupled to the base, a second curved section coupled to the first straight section, a third straight section coupled to the second curved section, and a fourth curved section, the second curved section comprising a plurality of curves that change direction of the clip attached from a rearward direction toward a forward direction.

16. The tennis training system of claim 15, wherein the second curved section changes from the rearward direction to the forward direction at a horizontal distance of about 36"-44".

17. The tennis training system of claim 15, wherein the second curved section causes the clip to drop from the rearward direction to the forward direction at a vertical distance of about 24"-34".

* * * * *